US005299634A

United States Patent [19]

Toyoda et al.

[11] Patent Number: 5,299,634

[45] Date of Patent: Apr. 5, 1994

[54] INDOOR UNIT OF A VENTILATION SYSTEM, VENTILATION AND AIR CONDITIONER

[75] Inventors: Akinori Toyoda; Akio Fukushima; Yasuo Sone; Hiroyuki Oohara; Yasuyuki Arai; Akihiro Matsushita, all of Shizuoka, Japan

[73] Assignee: Mitsubishi Denki Kabushiki Kaisha, Tokyo, Japan

[21] Appl. No.: 946,570

[22] Filed: Sep. 18, 1992

[30] Foreign Application Priority Data

Sep. 26, 1991 [JP] Japan ..... 3-247679
Apr. 21, 1992 [JP] Japan ..... 4-101121

[51] Int. Cl.[5] ..... F01N 7/00

[52] U.S. Cl. ..... 165/135; 181/225; 454/906

[58] Field of Search ..... 165/135; 415/119; 181/224, 225; 454/233, 906

[56] References Cited

U.S. PATENT DOCUMENTS

| | | | |
|---|---|---|---|
| 2,176,319 | 10/1939 | Anderson | 165/135 |
| 2,638,757 | 5/1953 | Borgerd | 165/135 |
| 2,873,097 | 2/1959 | Brandi | 165/135 |
| 2,932,956 | 4/1960 | Chieregatti | 165/135 |
| 3,455,378 | 7/1969 | Honnold, Jr. | 165/135 |
| 3,805,542 | 4/1974 | Hosoda et al. | 62/262 |
| 3,978,919 | 9/1976 | Fachbach et al. | 165/135 |

FOREIGN PATENT DOCUMENTS

| | | | |
|---|---|---|---|
| 66699 | 5/1980 | Japan | 165/135 |
| 58-71613 | 5/1983 | Japan . | |
| 280329 | 12/1986 | Japan | 454/906 |
| 91740 | 4/1987 | Japan | 454/233 |
| 255756 | 11/1987 | Japan | 454/233 |
| 1-78292 | 5/1989 | Japan . | |
| 3-229996 | 10/1991 | Japan . | |
| 3-237298 | 10/1991 | Japan . | |
| 1093256 | 11/1967 | United Kingdom . | |
| 1339690 | 12/1973 | United Kingdom . | |
| 1420674 | 1/1976 | United Kingdom . | |
| 1486461 | 9/1977 | United Kingdom . | |
| 1511625 | 5/1978 | United Kingdom . | |
| 2095752 | 10/1982 | United Kingdom . | |
| 2121879 | 1/1984 | United Kingdom . | |
| 2134647 | 8/1984 | United Kingdom . | |
| 2157765 | 10/1985 | United Kingdom . | |

*Primary Examiner*—John Rivell
*Assistant Examiner*—L. R. Leo
*Attorney, Agent, or Firm*—Oblon, Spivak, McClelland, Maier & Neustadt

[57] ABSTRACT

In an air conditioner indoor unit having a ventilator and a heat exchanger, there are provided an upper casing of the ventilator made from a porous structure having air permeability, a lower casing of the ventilator having airtightness, and an air chamber formed at the back of the upper casing.

1 Claim, 9 Drawing Sheets

INDOOR UNIT OF A VENTILATION SYSTEM, VENTILATION AND AIR CONDITIONER

BACKGROUND OF THE INVENTION

Field of the Invention

The present invention relates to an indoor unit configuration of a ventilation system, a ventilator and an air conditioner indoor unit in which reduction of noise is attained.

Related Art

A conventional example of this type air conditioner has been described in Unexamined Japanese Utility Model Application No. Sho 58-71613. A conventional example of the ventilator as a constituent member of the air conditioner indoor unit has been described in Unexamined Japanese Utility Model Application No. Hei 1-78292. FIG. 17 is a sectional view showing a conventional air conditioner indoor unit, and FIG. 18 is a perspective view thereof. In the drawings, the reference numeral 1 designates a ceiling panel, 2 a suction grill which forms an inlet port and 3 a ventilator disposed between the suction grill 2 and the ceiling panel 1. The reference numeral 4 designates a heat exchanger which is fixed to the ceiling panel 1 or the like. The reference numeral 5 designates a partition plate which is provided between the ventilator 3 and the heat exchanger 4 to form an air inlet chamber 10 and an air outlet chamber 11. The reference numeral 6 designates a decorative panel which is fixed to the partition plate 5 or a side wall (not shown) The reference numeral 7 designates a drain pan provided at the lower portion of the heat exchanger 4 and 8 a front panel fixed to the ceiling panel 1 or the like. The reference numeral 9 designates a blowout grill which forms an outlet port. The reference numeral 12 designates a large number of through holes which are of one size and are arranged at regular intervals in a portion of the ceiling panel 1 between the partition plate 5 and the heat exchanger 4 to form an outlet chamber of the ventilator 3 as shown in FIG. 16. The reference numeral 13 designates a noise absorbing material, such as a urethane foam material, stuck to the inside of the ceiling panel 1 to block the through holes at the inside thereof.

FIG. 19 is a vertical sectional view showing a conventional ventilator as described in the Unexamined Japanese Utility Model Application No. Hei 1-78292, and FIG. 20 is a partly sectional view thereof. In the drawings, the reference numeral 14 designates a fan, 15 a blower casing having the fan 14 in its inside, 15*a* an outlet, 16 a porous structure provided along the inner surface of the blower casing 15 so as to be insulated from the inner surface of the blower casing 15, and 17 an air layer formed between the blower casing 15 and the porous structure 16.

The operation of the ventilator and the operation of the air conditioner will be described hereunder. The operation of the air conditioner as described in the Unexamined Japanese Utility Model Application No. Sho 58-71613 will be described now with reference to FIGS. 17 and 18. Indoor air sucked into the inlet chamber 10 through the suction grill 2 is blown out to the air outlet chamber 11 by the action of the ventilator 3 and passes through the heat exchanger 4, so that air is blown indoors from the blowout grill 9. At this time, ventilation noise generated from the ventilator 3 and air stream noise caused by air turbulence in the indoor unit are radiated from the suction grill 2 and the blowout grill 9. The noise generated in the inside is partially absorbed to the noise absorbing material 13 stuck to the ceiling panel 1. Furthermore, the noise is diffused upwards with respect to the ceiling panel 1 through the large number of through holes 12 just above the noise absorbing material. As a result, a part of noise generated from the air conditioner can be diffused so that noise propagated from the suction grill 2 and the blowout grill 9 can be suppressed to reduce the level of noise in the indoor living area.

The operation of the ventilator as described in the Unexamined Japanese Utility Model Application No. Hei 1-78292 will be described with reference to FIGS. 19 and 20. Air flowing in from the axial direction by the rotation of the fan 14 is pressed out centrifugally, so that the air flows along the porous structure 16 provided in the inner surface of the blower casing 15 and is collected. The collected air is blown out through the outlet 15*a*. At this time, noise generated in the fan 14 flows together with the air, so that the noise is diffused radially from the fan 14. A part of the noise passes through the porous structure 16 and propagates in the air layer 17 in the inside thereof to strike the blower casing 15. Then, the noise reflects and propagates in the reverse direction, so that the noise is canceled by the next reflected noise. As a result, noise is suppressed.

The conventional air conditioner indoor unit according to the Japanese Utility Model Application No. Sho 58-71631 is constructed as described above to reduce noise by the action of the through holes 12 provided in the ceiling panel 1 and the action of the noise absorbing material 13. It is therefore necessary to use a continuously foamed air-permeable material as the noise absorbing material 13 to achieve a noise absorbing effect. There arises a problem in that air leakage occurs through the noise absorbing material 13 to reduce the quantity of air passing through the heat exchanger to thereby reduce the capacity thereof. A measure to increase the output power of the ventilator 3 to prevent the reduction of the air quantity cannot be used as a radical measure, because ventilation noise in the ventilator 3 is increased by this measure. If the through holes 12 of the ceiling panel 1 are blocked to prevent air leakage, there arises a problem in that the noise absorbing effect by the noise absorbing material 13 is lowered. The ventilator 3 stands a large part of all noise generation sources in the air conditioner. Accordingly, the area of the noise absorbing material stuck must be widened so that noise generated can be absorbed to the noise absorbing material. In the case of the conventional air conditioner, the area of the noise absorbing material stuck is insufficient. There arises a disadvantage in that the noise absorbing effect cannot be achieved sufficiently.

The conventional ventilator according to Unexamined Japanese Utility Model Application No. Hei 1-78292 is constructed as described above. Accordingly, the blower casing 15 must have the form in which not only a porous member is arranged in the outside of the fan 14 but an air layer is secured in the outside of the porous member. There arises a disadvantage in that the height of the casing becomes so large that a large setting space is required.

SUMMARY OF THE INVENTION

The present invention was made in view of the aforegoing problems accompanying the conventional apparatus, and an object of the invention is to provide a ventilation system, a ventilator and an air conditioner indoor unit in which not only lowering of air quantity caused by air leakage or the like can be prevented but noise generated in the ventilator portion as a main noise generation source can be reduced, and to provide a parts arrangement adapted for this system.

Another object of the present invention is to provide a ventilation system, a ventilator and an air conditioner indoor unit in which noise can be reduced without increase of the external size of the panel or casing perpendicular to the direction of the air outlet.

The ventilation system according to the present invention comprises: a first casing portion disposed in an inlet chamber in a panel incorporating a ventilator and formed from a closed structure to form a part of the ventilator, the inlet chamber having an air suction port provided in the panel; a second casing portion united with the first casing portion into one body and formed from an air-permeable porous structure to form a casing of the ventilator; and an air chamber formed by a partition plate for partitioning the second casing portion and the inlet chamber in the panel.

The ventilator according to the present invention comprises: a scroll-curve-shaped air-permeable porous structure provided in a casing portion which is arranged opposite to an outlet port of a ventilator casing and deformed so as to be outward different from a scroll curve; and an air chamber formed between the porous structure and the casing portion.

The ventilator according to the present invention comprises: an air-permeable porous structure which is fixed to any one of a main plate for supporting an impeller, a shaft for rotating the impeller through the main plate and a driving means for driving the impeller and is shaped like a cone in which the inside projecting to the inlet port side is hollow; and an air chamber formed by the porous structure and the main plate.

The air conditioner indoor unit according to the present invention has a ventilator, a heat exchanger, a partition plate disposed between the ventilator and the heat exchanger, a drain pan provided at the lower portion of the heat exchanger, and a panel for incorporating these parts, the air conditioner indoor unit further comprising: a concave portion formed by a partition plate side surface of the drain pan incorporated in the panel, a surface of the partition plate fixed to the panel opposite to the drain pan and a surface of the panel between the drain pan and the partition plate; and a porous structure disposed on the opening side of the concave portion to form an air chamber between the porous structure and the concave portion.

The air conditioner indoor unit according to the present invention comprises a ventilator, a heat exchanger, a partition plate disposed between the ventilator and the heat exchanger, and a panel for incorporating these parts, the air conditioner indoor unit further comprising: a porous structure which is disposed in the outer circumference of the end surface of an outlet port of the ventilator so that the outlet port of the ventilator projects out with respect to the partition plate; and an air chamber formed by the partition plate and the panel.

In the ventilation system according to the present invention, not only noise from the ventilator is absorbed efficiently but air leakage is prevented, by a combination of an air-permeable porous structure forming a part of the ventilator casing and an air chamber formed at the back surface of the porous structure In the ventilator according to the present invention, not only noise from the ventilator is absorbed efficiently but air leakage is prevented, by a combination of a scroll-curve-shaped air-permeable porous structure provided in the inside of the casing portion of the ventilator and an air chamber formed at the back surface of the porous structure or by a combination of a hollow-cone-shaped air-permeable porous structure provided at the inlet port of the ventilator and an air chamber formed at the back surface of the porous structure.

In the air conditioner indoor unit according to the present invention, not only noise from the ventilator is absorbed efficiently but air leakage is prevented, by a combination of a concave portion formed by the drain pan, the partition plate and the panel and a porous structure provided on the opening side of the concave portion to form an air chamber between the porous structure and the concave portion or by a combination of a porous structure provided on the outer circumference of the end surface of the outlet port of the ventilator and an air chamber formed at the back surface of the porous structure.

DESCRIPTION OF THE PREFERRED EMBODIMENTS

The preferred embodiments of the present invention will now be described in detail with reference to the accompanying drawings.

Figure 1:
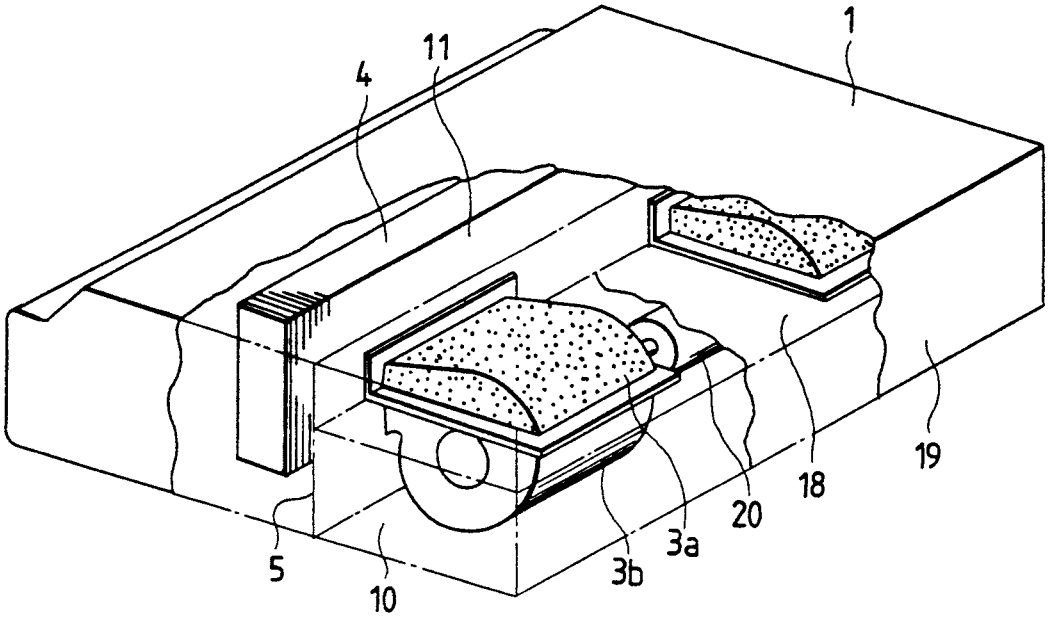
FIG. 1 is a perspective view of an air conditioner indoor unit according to a first embodiment of the present invention.
Figure 4:
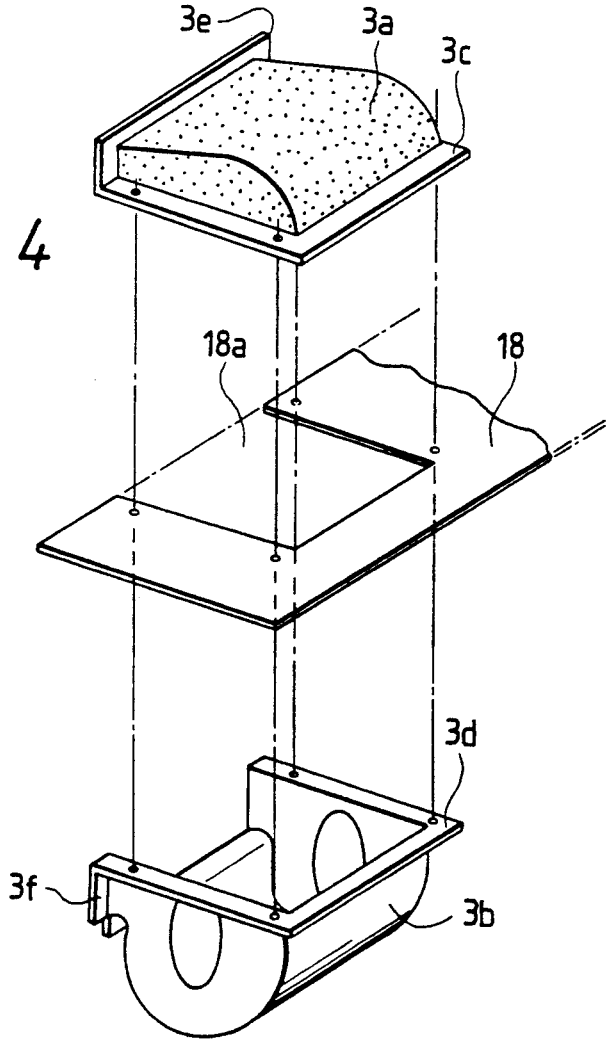
FIG. 4 is a structural view of the ventilator portion of the air conditioner indoor unit in the first embodiment shown in FIG. 1.
Figure 2:
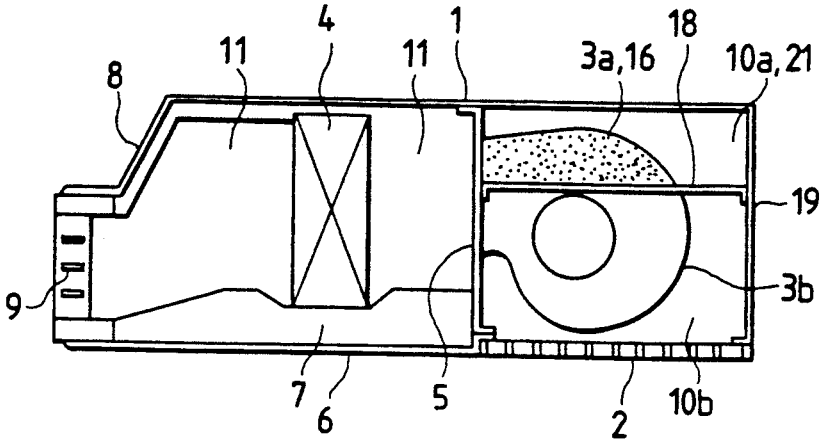
FIG. 2 is a sectional view of the air conditioner indoor unit in the first embodiment shown in FIG. 1.
Figure 3:
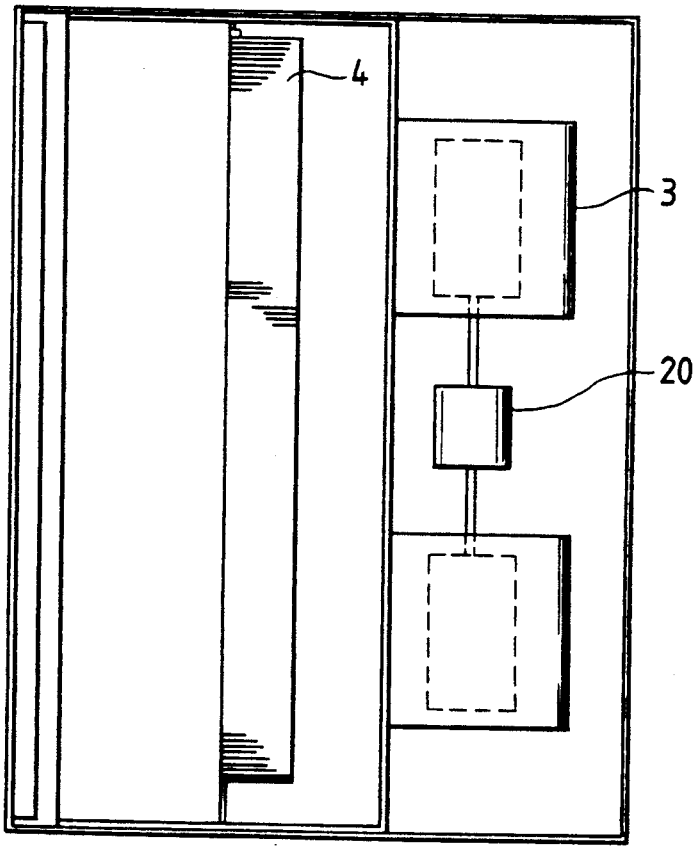
FIG. 3 is a plan sectional view of the air conditioner indoor unit in the first embodiment shown in FIG. 1.
Figure 17:
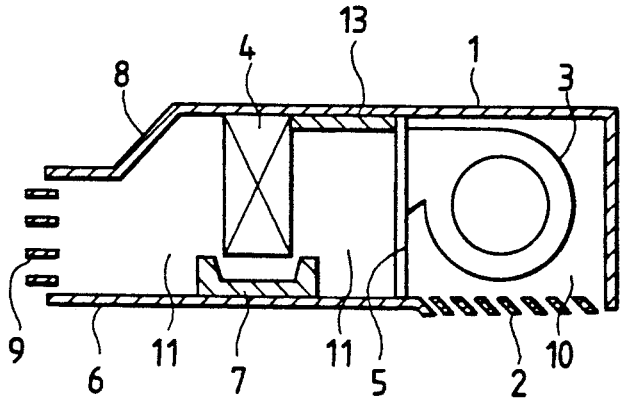
FIG. 17 is a sectional view showing a conventional air conditioner indoor unit.
Figure 18:
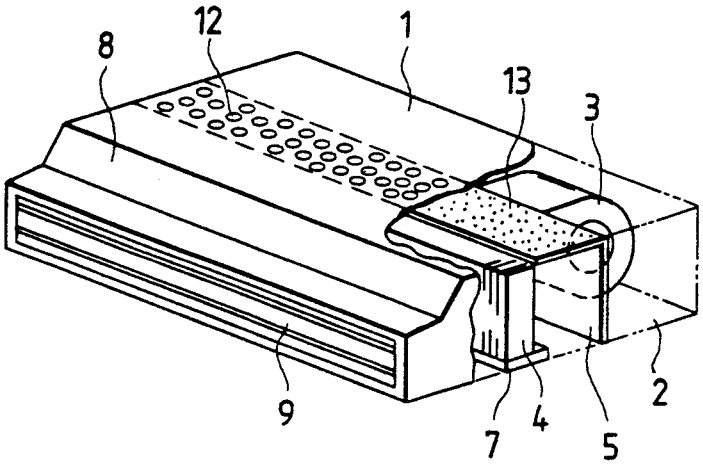
FIG. 18 is a perspective view showing the conventional air conditioner indoor unit.

A first embodiment will be described hereunder with reference to FIGS. 1, 2, 3 and 4. FIG. 1 is a perspective view showing an air conditioner indoor unit, FIG. 2 is a sectional view thereof, FIG. 3 is a plan view thereof, and FIG. 4 is a structural view of a ventilator thereof. In the drawings, parts the same as or equivalent to those in FIGS. 17 and 18 are referenced correspondingly. In the drawings, the reference numeral 1 designates a ceiling panel, 2 a suction grill which forms an inlet port and 3 a ventilator disposed between the suction grill 2 and the ceiling panel 1. The ventilator 3 is provided so that the casing thereof is separated into an upper casing 3*a* and a lower casing 3*b*. The upper casing 3*a* is formed from an air-permeable rigid porous structure, and the lower casing 3*b* is formed from an air-impermeable structure. The reference numeral 4 designates a heat exchanger which is fixed to the ceiling panel 1 or the like. The reference numeral 5 designates a first partition plate which is provided between the ventilator 3 and the heat exchanger 4 to form an air inlet chamber 10 and an air outlet chamber 11. The reference numeral 6 designates a decorative panel which is fixed to the partition plate 5 or a side wall (not shown). The reference numeral 7 designates a drain pan provided at the lower portion of the heat exchanger and 8 a front panel fixed to the ceiling panel or the like. The reference numeral 9 designates a blowout grill which forms an outlet port. The reference numeral 20 designates a motor for driving the ventilator. The reference numeral 18 designates a second partition plate for partitioning the air inlet chamber 10 into upper and lower parts at a surface where the upper and lower casings of the ventilator 3 engage with each other. The upper part of the air inlet chamber 10 separated by the second partition plate forms a closed space 10*a* surrounded by the upper panel 1, the first partition plate 5 and a rear panel 19. The closed space 10*a* is communicated with the inside of the ventilator casing and the lower part 10*b* of the air inlet chamber through small holes of the upper casing 3*a* formed from an air-permeable rigid porous structure.

FIG. 4 is a view showing the structure of the ventilator 3 and the second partition plate 18. The upper casing 3*a* and the lower casing 3*b* are attached to each other so that the second partition plate 18 is disposed therebetween. A portion of the second partition plate 18 where the upper and lower casings engage with each other is formed as an angular through hole 18*a*. In order to prevent air leakage, flanges 3*c* and 3*d* are formed at a portion where the upper and lower casings are brought into contact with the second partition plate. Also, flanges 3*e* and 3*f* are formed at a portion where the upper and lower casings are brought into contact with the first partition plate.

The operation of the embodiment will be described hereunder. Indoor air sucked through the suction grill 2 by the action of the ventilator 3 passes through the heat exchanger 4, so that cool or hot air is blown indoors from the blowout grill 9. Noise is produced from the ventilator 3 when the ventilator 3 is operated. The noise propagates to the air inlet chamber 10 and the air outlet chamber 11. In this embodiment, the upper casing 3*a* of the ventilator 3 is formed from a porous structure, so that the noise can be absorbed to this portion. As a result, the noise produced from the ventilator 3 can be suppressed. The porous structure is formed from a material having continuous pores, so that the upper casing 3*a* has air-permeability. Accordingly, the inside space of the ventilator 3 and the upper space 10*a* of the air inlet chamber 10 are communicated with each other through a large number of pores in the porous structure. There is, however, no air leakage to the outside of the unit, because the upper space 10*a* of the air inlet chamber 10 is enclosed with the upper panel 1, the first partition plate 5, the second partition plate 18 and the rear panel 19 which form an airtight structure (for example, plate). When the ventilator 3 is operated, the pressure of the inside of the ventilator becomes positive. As a result, the pressure of the upper space 10*a* of the air inlet chamber 10 becomes positive. There is, however, no passage through which air is leaked. Accordingly, air leakage through the porous structure of the upper casing 3*a* is prevented, so that deterioration of aerodynamic characteristic of the ventilator is prevented.

On the other hand, noise produced from the ventilator 3 propagates as compressional wave. When the compressional wave passes through small pores of the porous structure of the upper casing 3*a*, the porous structure serves as resistance to absorb the energy of the compressional wave, that is, acoustic energy. Then, the compressional wave propagates to the upper space 10*a* of the air inlet chamber 10 as a closed space and reflects at the upper panel 1, the first partition plate 5, the second partition plate 18, the rear panel 19 and the like which serve as an enclosure of the upper space 10*a*. As a result, the compressional wave passes through the porous structure of the upper casing 3*a* again, so that the noise absorbing effect is promoted. That is, the upper space 10*a* of the air inlet chamber 10 serves as a back air layer for the double purpose of improving the noise absorbing characteristic of the upper casing formed from a porous structure and preventing deterioration of the aerodynamic characteristic of the ventilator, so that noise produced from the ventilator can be reduced greatly. The porous structure constituting the upper casing is formed by fusion molding of a rigid material such as a bead-shaped plastic material. Accordingly, the porous material per se can be used as a strength material, so that no member is required for mounting the upper casing.

Figure 5:
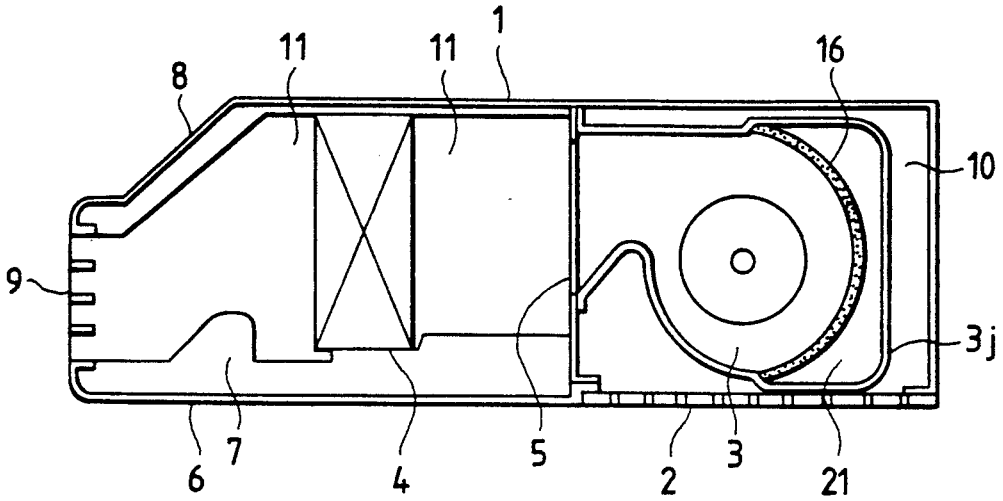
FIG. 5 is a sectional view of an air conditioner indoor unit according to a second embodiment of the present invention.
Figure 6:
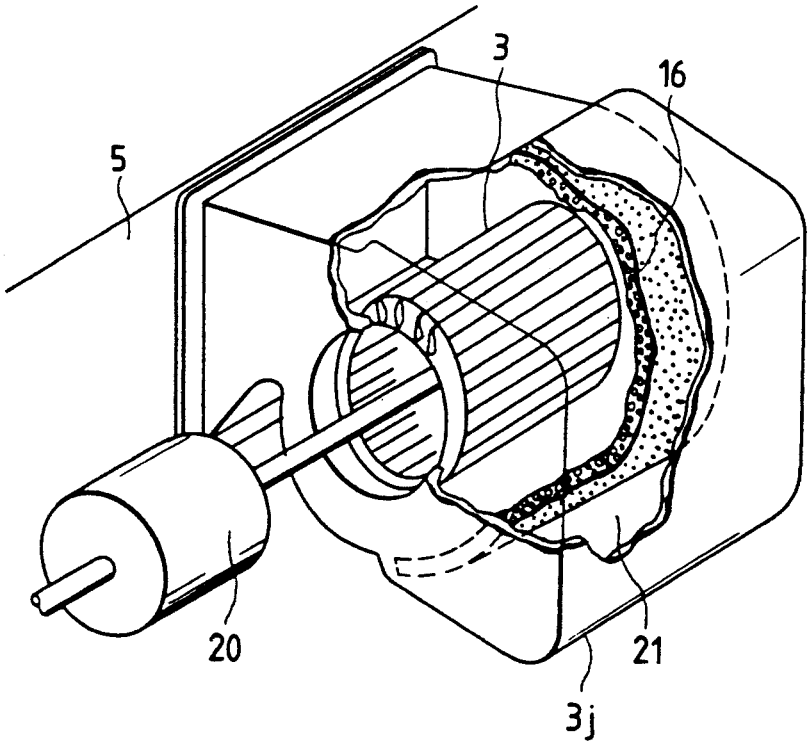
FIG. 6 is a perspective view of the casing in the air conditioner indoor unit in the second embodiment shown in FIG. 5.

A second embodiment will be described hereunder with reference to FIGS. 5 and 6. FIG. 5 is a sectional view showing an air conditioner, and FIG. 6 is a perspective view of the casing thereof. In the drawings, the reference numeral designates a ceiling panel, 2 a suction grill which forms an inlet port and 3 a ventilator disposed between the suction grill 2 and the ceiling panel 1. The ventilator 3 is formed from a deformed casing 3*j* different in shape from the scroll curve. An air-permeable rigid porous structure 16 which forms a part of the scroll curve is disposed in the inside of the deformed casing 3*j*. An air chamber 21 is provided in the inside of the deformed casing 3*j*. The reference numeral 4 designates a heat exchanger which is fixed to the ceiling panel 1 or the like. The reference numeral 5 designates a partition plate which is provided between the ventilator 3 and the heat exchanger 4 to form an air inlet chamber 10 and an air outlet chamber 11. The reference numeral 6 designates a decorative panel which is fixed to the partition plate 5 or a side wall (not shown). The reference numeral 7 designates a drain pan provided at the lower portion of the heat exchanger 4 and 8 a front panel fixed to the ceiling panel or the like. The reference numeral 9 designates a blowout grill which forms an outlet port. The reference numeral 20 designates a motor f©r driving the ventilator.

The operation of the embodiment will be described hereunder. Indoor air sucked through the suction grill 2 by the action of the ventilator 3 passes through the heat exchanger 4, so that cool or hot air is blown indoors from the blowout grill 9. Noise is produced from the ventilator 3 when the ventilator 3 is operated. The noise propagates to the air inlet chamber 10 and the air outlet chamber 11. In this embodiment, the porous structure 16 forming a part of the scroll curve is arranged in the inside of the deformed casing 3*j* of the ventilator 3, so that the noise can be absorbed to this portion. As a result, the noise produced from the ventilator 3 can be suppressed. The porous structure 16 is formed from a material having continuous pores, so that the porous structure has air-permeability. Accordingly, the air chamber 21 partitioned by the porous structure 16 and the air passage of the deformed casing 3*j* are communicated with each other through a large number of pores. There is, however, no air leakage to the outside of the deformed casing 3*j*, because the deformed casing 3*j* is formed from an airtight material (such as plate, plastic or the like). Accordingly, deterioration of aerodynamic characteristic of the ventilator 3 is prevented.

On the other hand, noise produced from the ventilator 3 propagates as compressional wave. When the compressional wave passes through small pores of the porous structure 16, the porous structure serves as resistance to absorb the energy of the compressional wave, that is, acoustic energy. Then, the compressional wave propagates to the air chamber 21 as a closed space and reflects at the deformed casing 3*j* which serves as an enclosure of the air chamber. As a result, the compressional wave passes through the porous structure 16 again, so that the noise absorbing effect is promoted. That is, the air chamber 21 in the inside of the deformed casing 3*j* serves to improve noise absorbing characteristic, so that noise produced from the ventilator 3 can be reduced greatly. The porous structure 16 forming a part of the scroll curve is formed by fusion molding of a rigid material such as a bead-shaped plastic material. Accordingly, the porous structure has strength, so that it can be fixed easily if a hook or the like is provided in the deformed casing 3*j*.

Figure 7:
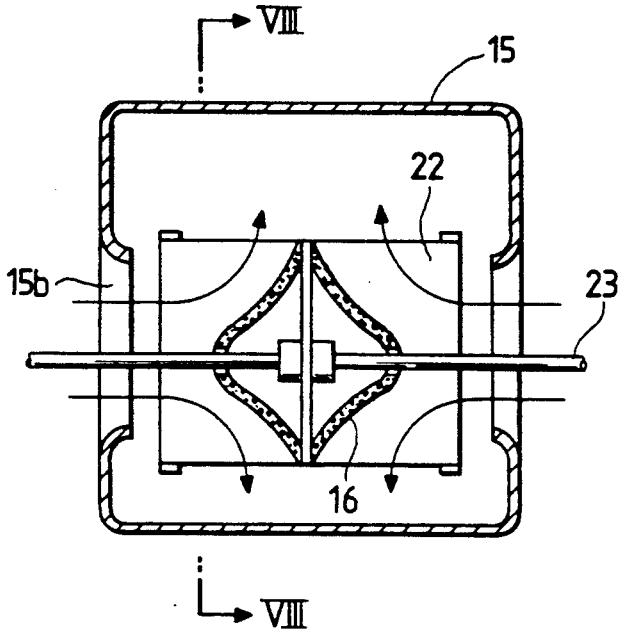
FIG. 7 is a sectional view of a ventilator according to a third embodiment of the invention.
Figure 8:
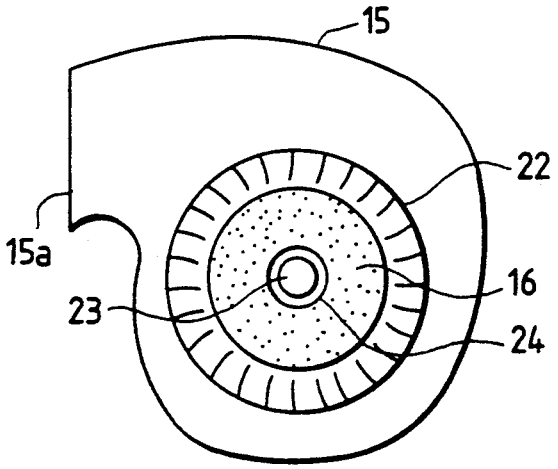
FIG. 8 is a sectional view of the ventilator in the third embodiment shown in FIG. 7.
Figure 9:
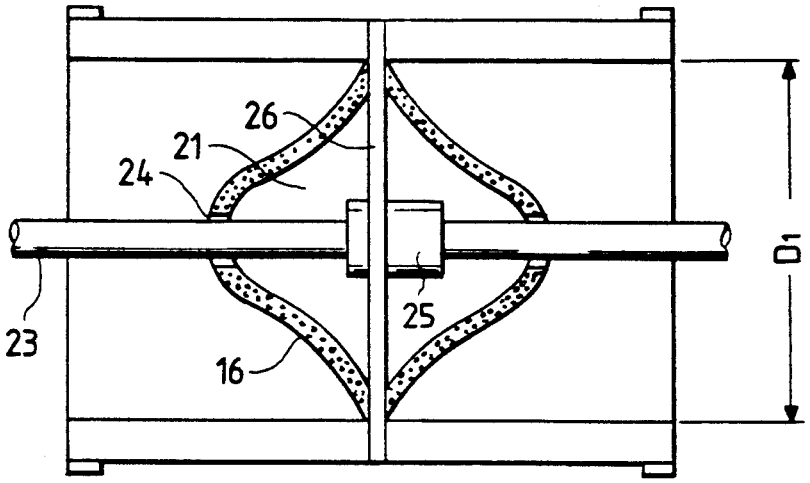
FIG. 9 is a partly sectional view of the ventilator in the third embodiment shown in FIG. 7.
Figure 19:
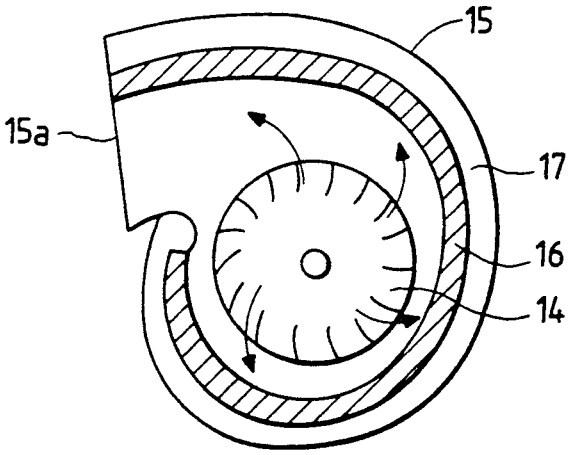
FIG. 19 is a sectional view showing a conventional ventilator.
Figure 20:
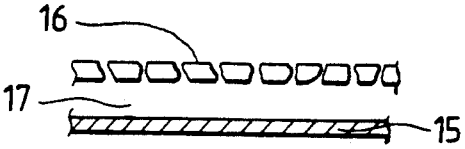
FIG. 20 is a partly sectional view showing the conventional ventilator.

A third embodiment will be described hereunder with reference to FIGS. 7, 8 and 9. FIG. 7 is a sectional view of a centrifugal ventilator formed by using a double suction type multiblade impeller in a ventilator which is a constituent member of the air conditioner indoor unit, FIG. 8 is a sectional view taken along the line VIII—VIII of FIG. 7, and FIG. 9 is a partly sectional view thereof. In each of the drawings and FIGS. 19 and 20, like numerals refer to like parts. In the drawings, the reference numeral 22 designates a double suction type multiblade impeller, 15 a blower casing having the impeller 22 mounted to the inside thereof, 15*a* an outlet of the blower casing and 15*b* an inlet thereof. The reference numeral 23 designates a rotation shaft for driving the ventilator, 25 a boss portion for fixing the multiblade impeller 22 to the rotation shaft 23, 26 a main plate for supporting the boss portion, 16 an air-permeable porous structure closely fixed to the main plate 26 by an adhesive agent or by screwing to form a hollow cone, 24 a through hole provided at the horn base portion of the porous structure to pierce the shaft therein, and 21 an air chamber formed by the main plate 26 and the porous structure 16. The reference symbol D1 designates the inner diameter of the multiblade impeller.

The operation of the embodiment will be described hereunder. The double suction type multiblade impeller 22 makes a rotating motion by driving the rotation shaft 23, so that air is sucked along the shaft from the casing inlet 15*b* to the inside of the multiblade impeller 22. The air is radiated along the smooth conical surface of the air-permeable porous structure 16 attached to the inside of the multiblade impeller 22 and passes through blades of the multiblade impeller so that the air flows centrifugally. The air is collected along the spiral form of the blower casing 15 and then blown out through the blower casing outlet 15*a*. The porous structure 16 is shaped like a conical horn so that a through hole 24 being smallest to pierce the rotation shaft 23 is provided in the convex portion of the porous structure. The diameter of the porous structure opened in opposite directions is adjusted to the inner diameter D1 of the impeller. Furthermore, the end surface of the porous structure is cut perpendicularly to the center axis of the conical form to prevent the end surface from touching the blades. Accordingly, the blades can be used effectively as a whole, so that there arises no irregular flow.

Among ventilation noises generated when air passes through the impeller, noise propagating to the suction side of the impeller propagates as compressional wave. When the compressional wave passes through small pores of the porous structure 16, the porous structure serves as resistance to absorb acoustic energy. Then, the compressional wave propagates to the air chamber 21 and reflects at the main plate 26 which serves as a partition plate for partitioning the sucked air. As a result, the compressional wave propagates in the direction reverse to the direction of incidence, so that the wave is canceled by the next incident wave and then passes through the porous structure 16 again to thereby promote the noise absorbing effect. Accordingly, noise generated in the ventilator can be reduced greatly.

Figure 10:
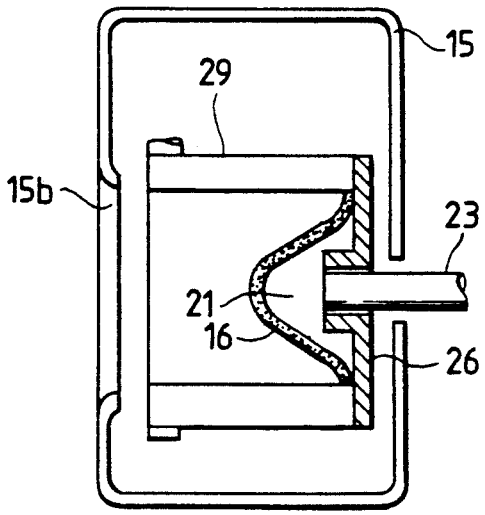
FIG. 10 is a sectional view of a ventilator according to a fourth embodiment of the invention.

Although the third embodiment has shown the case of a centrifugal ventilator using a double suction type multiblade impeller, a fourth embodiment shows the case of a centrifugal ventilator using a single suction type multiblade impeller as will be described with reference to FIG. 10. In the drawings, parts the same as or equivalent to those in FIGS. 7, 8 and 9 are referenced correspondingly. In the drawing, the reference numeral 29 designates a single suction type multiblade impeller, 15 a blower casing having the impeller 22 mounted to the inside thereof, and 15*b* an inlet of the blower casing. The reference numeral 23 designates a rotation shaft for driving the ventilator, 26 a main plate of the single suction type multiblade impeller, 16 an air-permeable porous structure closely fixed to the main plate 26 by an adhesive agent or by screwing to form a hollow cone, and 21 an air chamber formed by the porous structure 16 and the main plate 26.

The operation of the embodiment will be described hereunder. The single suction type multiblade impeller 29 makes a rotating motion by driving the rotation shaft 23, so that air is sucked along the shaft from the casing inlet 15*b* to the inside of the multiblade impeller 29. The air is radiated along the smooth conical surface of the air-permeable porous structure 16 attached to the inside of the multiblade impeller 29 and passes through blades of the multiblade impeller so that the air flows centrifugally. The air is collected along the spiral form of the blower casing 15 and then blown out through the blower casing outlet 15*a*. The porous structure 16 is shaped like a conical horn. The diameter of the porous structure opened in opposite directions is adjusted to the inner diameter of the impeller. Furthermore, the end surface of the porous structure is cut perpendicularly to the center axis of the conical form to prevent the end surface from touching the blades. Accordingly, the blades can be used effectively as a whole, so that there arises no irregular flow.

Among ventilation noises generated when air passes through the impeller, noise propagating to the suction side of the impeller propagates as compressional wave. When the compressional wave passes through small pores of the porous structure 16, the porous structure serves as resistance to absorb acoustic energy. Then, the compressional wave propagates to the air chamber 21 and reflects at the main plate 26. As a result, the compressional wave propagates in the direction reverse to the direction of incidence, so that the wave is canceled by the next incident wave and then passes through the porous structure 16 again to thereby promote the noise absorbing effect. Accordingly, noise generated in the ventilator can be reduced greatly.

Figure 11:
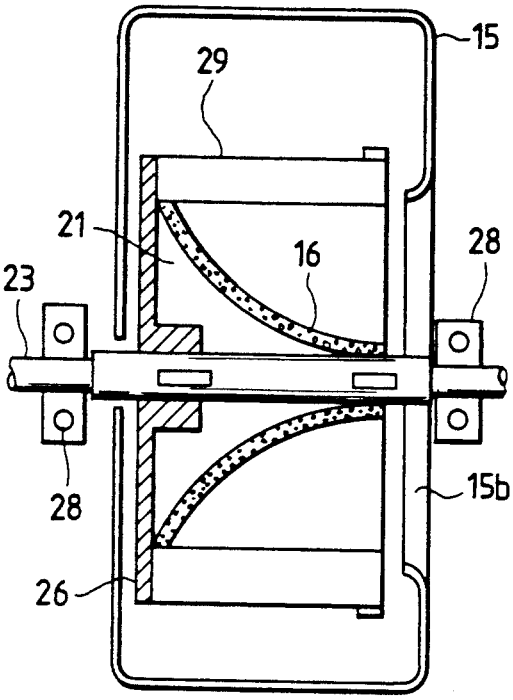
FIG. 11 is a sectional view of a ventilator according to a fifth embodiment of the invention.

Although the fourth embodiment has shown the case where a single side bearing (not shown) is applied to the driving rotation shaft in the centrifugal ventilator using a single suction type multiblade impeller, a fifth embodiment shows the case where rotation shaft bearings are provided on both sides as will be described with reference to FIG. 11. In the drawings, the parts the same as or equivalent to those in FIGS. 7 and 8 are referenced correspondingly. In the drawing, the reference numeral 29 designates a single suction type multiblade impeller, 15 a blower casing having the impeller 22 mounted to the inside thereof, and 15*b* an inlet of the blower casing. The reference numeral 23 designates a rotation shaft for driving the centrifugal ventilator, 26 a main plate of the single suction type multiblade impeller, and 28 a pair of shaft bearings. The porous structure 16 is a conical air-permeable structure in which both ends are opened. One end of the opening is closely fixed to the main plate of the impeller, and the other end is closely fixed to the rotation shaft 23 by an adhesive agent or by screwing. The reference numeral 21 designates an air chamber formed by the porous structure 16 and the main plate 26.

The operation of the embodiment will be described hereunder. The single suction type multiblade impeller 29 makes a rotating motion by driving the rotation shaft 23, so that air is sucked along the shaft from the casing inlet 15*b* to the inside of the multiblade impeller 29. The air is radiated along the smooth conical surface of the air-permeable porous structure 16 attached to the inside of the multiblade impeller 29 and passes through blades of the multiblade impeller so that the air flows centrifugally. The air is collected along the spiral form of the blower casing 15 and then blown out through the blower casing outlet 15*a*. The porous structure 16 is shaped like a cone. The diameter of the porous structure opened in opposite directions is adjusted to the inner diameter of the impeller. Furthermore, the end surface of the porous structure is cut perpendicularly to the center axis of the cone to prevent the end surface from touching the blades. Accordingly, the blades can be used effectively as a whole, so that there arises no irregular flow.

Among ventilation noises generated when air passes through the impeller, noise propagating to the suction side of the impeller propagates as compressional wave. When the compressional wave passes through small pores of the porous structure 16, the porous structure serves as resistance to absorb acoustic energy. Then, the compressional wave propagates to the air chamber 21 and reflects at the main plate 26. As a result, the compressional wave propagates in the direction reverse to the direction of incidence, so that the wave is canceled by the next incident wave and then passes through the porous structure 16 again to thereby promote the noise absorbing effect. Accordingly, noise generated in the ventilator can be reduced greatly.

Figure 12:
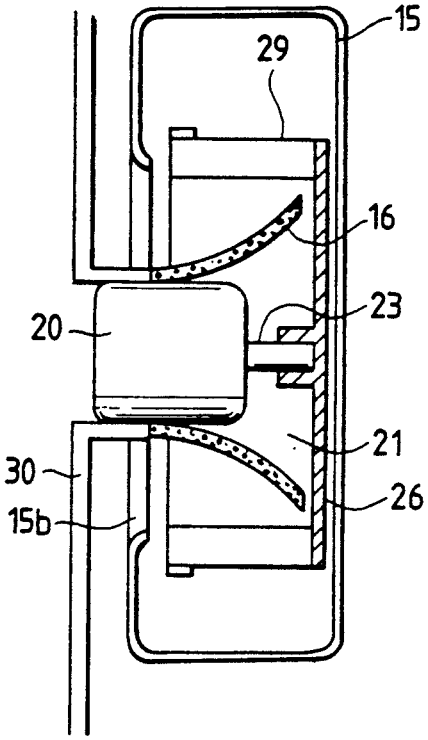
FIG. 12 is a sectional view of a ventilator according to a sixth embodiment of the invention.

Although the fourth embodiment has shown the case where the driving motor (not shown) is provided in the outside of the blower casing, a fifth embodiment shows the case where the motor is provided in the inside of the blower casing as will be described with reference to FIG. 12. In the drawings, the parts the same as or equivalent to those in FIGS. 7 and 8 are referenced correspondingly. In the drawing, the reference numeral 29 designates a single suction type multiblade impeller, 15 a blower casing having the impeller 22 mounted to the inside thereof, and 15*b* an inlet of the blower casing. The reference numeral 23 designates a rotation shaft for driving the centrifugal ventilator, 26 a main plate of the single suction type multiblade impeller, 20 a motor for driving the centrifugal ventilator, and 30 a leg for mounting the motor. The porous structure 16 is a conical air-permeable structure in which both ends are opened. One end of the opening is closely fixed to the outer circumferential surface of the motor, and the other end is closely fixed to the main plate of the impeller. The reference numeral 21 designates an air chamber formed by the porous structure 16 and the main plate 26.

The operation of the embodiment will be described hereunder. The single suction type multiblade impeller 29 makes a rotating motion by driving the rotation shaft 23, so that air is sucked along the shaft from the casing inlet 15*b* to the inside of the multiblade impeller 29. The air is radiated along the smooth conical surface of the air-permeable porous structure 16 attached to the inside of the multiblade impeller 29 and passes through blades of the multiblade impeller so that the air flows centrifugally. The air is collected along the spiral form of the blower casing 15 and then blown out through the blower casing outlet 15*a*.

Among ventilation noises generated when air passes through the impeller, noise propagating to the suction side of the impeller propagates as compressional wave. When the compressional wave passes through small pores of the porous structure 16, the porous structure serves as resistance to absorb acoustic energy. Then, the compressional wave propagates to the air chamber 21 and reflects at the main plate 26. As a result, the compressional wave propagates in the direction reverse to the direction of incidence, so that the wave is canceled by the next incident wave and then passes through the porous structure 16 again to thereby promote the noise absorbing effect. Accordingly, noise generated in the ventilator can be reduced greatly.

The porous structure 16 is shaped like a cone and fixed to the motor. The open side of the porous structure is not closely fixed to the main plate of the impeller, so that the noise reducing effect is lowered compared with the Embodiments 3, 4 and 5. The motor is provided in the inside of the casing, so that the size of the ventilator can be reduced.

Figure 13:
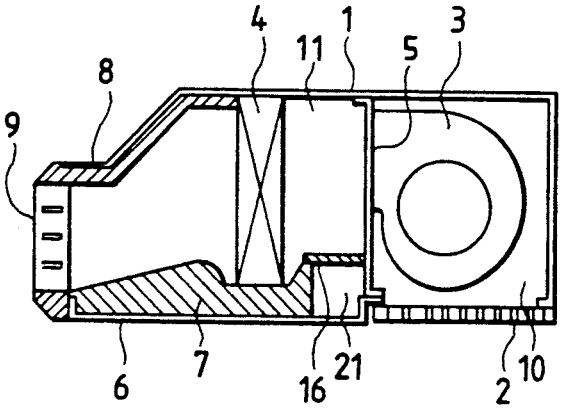
FIG. 13 is a sectional view of an air conditioner indoor unit according to a seventh embodiment of the invention.
Figure 14:
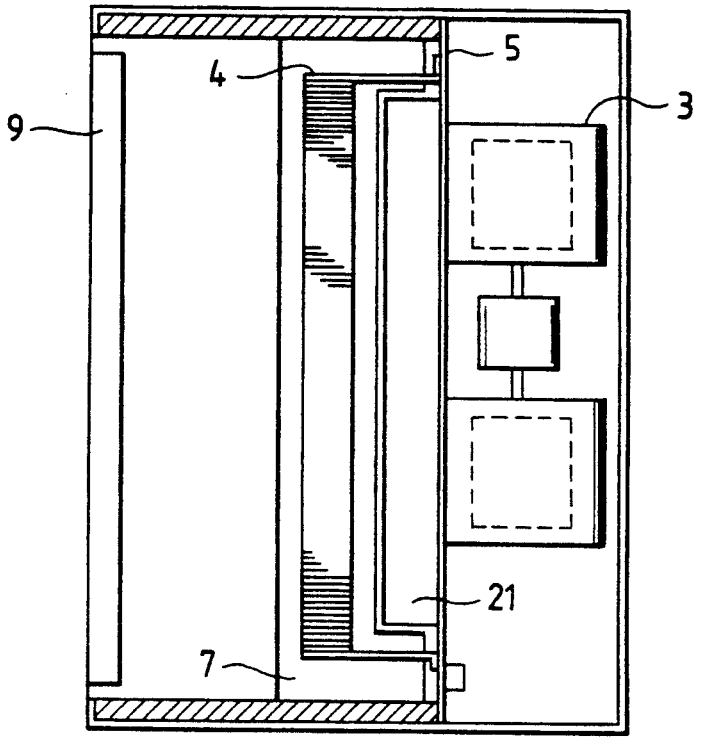
FIG. 14 is a plan view of the air conditioner indoor unit in the seventh embodiment shown in FIG. 13.

A seventh embodiment will be described hereunder with reference to FIGS. 13 and 14. FIG. 13 is a cross-sectional view showing an air conditioner indoor unit, and FIG. 14 is a plan view thereof. In the drawings, the parts the same as or equivalent to those in FIGS. 17 and 18 are referenced correspondingly. In the drawings, the reference numeral 1 designates a ceiling panel, 2 a suction grill and 3 a ventilator disposed between the suction grill 2 and the ceiling panel 1. The reference numeral 4 designates a heat exchanger which is fixed to the ceiling panel 1. The reference numeral 5 designates a partition plate which is provided between the ventilator 3 and the heat exchanger 4 to form an air inlet chamber 10 and an air outlet chamber 11. The reference numeral 6 designates a decorative panel which is fixed to the partition plate 5 or a side wall (not shown). The reference numeral 7 designates a drain pan. A concave portion is formed by the drain pan, the partition plate 5 and the decorative panel 6 disposed at the lower portion thereof. The reference numeral 16 designates a rigid porous structure attached to block the opening surface of the concave portion. The reference numeral 21 designates an air chamber formed by the porous structure 16, the drain pan 7, the partition plate 5 and the decorative panel 6.

The operation of the embodiment will be described hereunder. Indoor air sucked through the suction grill 2 by the action of the ventilator 3 passes through the heat exchanger 4, so that cool or hot air is blown indoors from the blowout grill 9. Noise is produced from the ventilator 3 when the ventilator 3 is operated. The noise propagates to the outlet chamber 11 and is absorbed to the porous structure 16 provided at the lower portion of the outlet chamber 11, so that noise propagating indoors from the blowout grill 9 is suppressed. The porous structure 16 is formed from a material having continuous pores. The air chamber 21 is communicated with the outlet chamber 11 through a large number of small pores of the porous structure. Except the surface covered with the porous structure 16, the air chamber 21 is surrounded by the drain pan 7, the partition plate 5 and the decorative panel which are respectively formed from airtight structures. Accordingly, air blown from the ventilator 3 is not leaked to the outside of the unit through the porous structure 16. On the other hand, noise produced from the ventilator propagates as compressional wave in the air passage in the inside of the unit. When the compressional wave passes through small pores of the porous structure 16, the porous structure serves as resistance to absorb the energy of the compressional wave, that is, acoustic energy. Then, the compressional wave propagates to the air chamber 21 as a closed space and reflects at the drain pan 7, the partition plate 5 and the decorative panel 6 which serve as an enclosure of the air chamber. As a result, the compressional wave passes through the porous structure 16 again, so that the noise absorbing effect is promoted. That is, the air chamber 21 serves as a back air layer to improve the noise absorbing characteristic of the noise absorbing material formed from a porous structure 16, so that noise produced in the inside of the air conditioner can be reduced greatly. The porous structure 16 is formed by fusion molding of a rigid material such as a bead-shaped plastic material. Accordingly, the porous structure 16 per se can be used as a strength material, so that no member is required for mounting the porous structure 16.

Because the porous structure 16 is shaped like a plate, it can be produced easily. Although the above description has been made about reduction of noise, the air chamber 21 may be used as a takeoff port in the case where an auxiliary heater is provided between the heat exchanger and the ventilator so that the porous structure 16 and the decorative panel 6 can be partially removed.

Figure 15:
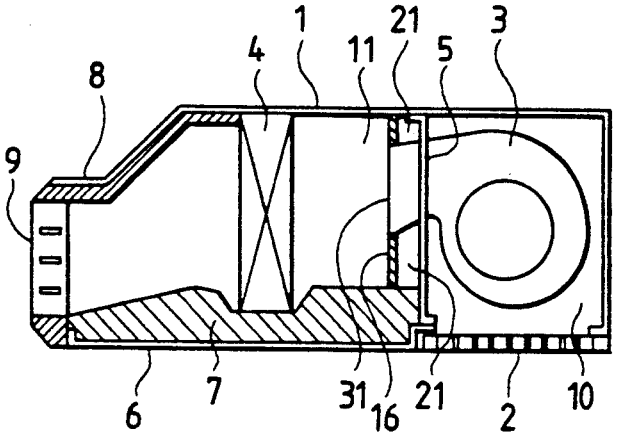
FIG. 15 is a sectional view of an air conditioner indoor unit according to an eighth embodiment of the invention.
Figure 16:
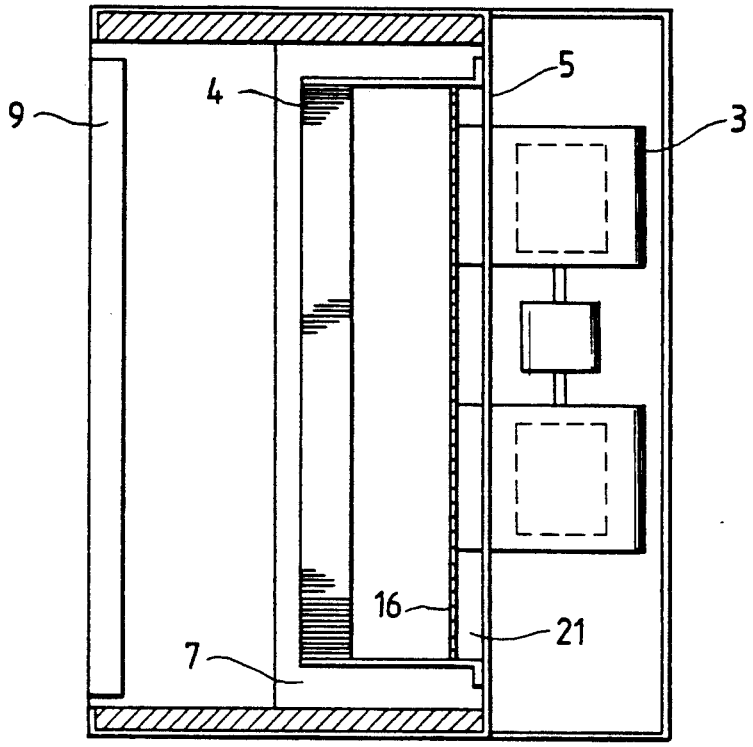
FIG. 16 is a plan view of the air conditioner indoor unit in the eighth embodiment shown in FIG. 15.

An eighth embodiment will be described hereunder with reference to FIGS. 15 and 16. FIG. 15 is a cross-sectional view showing an air conditioner indoor unit, and FIG. 16 is a plan sectional view thereof. In the drawings, the parts the same as or equivalent to those in FIGS. 17 and 18 are referenced correspondingly. In the drawings, the reference numeral 1 designates a ceiling panel, 2 a suction grill and 3 a ventilator disposed between the suction grill 2 and the ceiling panel 1. The reference numeral 4 designates a heat exchanger which is fixed to the ceiling panel 1. The reference numeral 5 designates a partition plate which is provided between the ventilator 3 and the heat exchanger 4 to form an air inlet chamber 10 and an air outlet chamber 11. The ventilator 3 and the partition plate 5 are arranged so that an outlet port 31 of the ventilator 3 is positioned to project toward the outlet chamber 11 side with respect to the partition plate 5. The reference numeral 6 designates a decorative panel which is fixed to the partition plate 5 or a side wall (not shown). The reference numeral 7 designates a drain pan which has an end surface being in contact with the partition plate 5. The porous structure 16 is a rigid porous structure provided so as to be parallel to the partition plate substantially at the position of the end surface of the outlet port 31 of the ventilator 3 and having an opening provided at the outlet port 31 of the ventilator 3. The reference numeral 21 designates an air chamber formed by the porous structure 16, the ceiling panel 1, the drain pan 7 and the partition plate 5.

The operation of the embodiment will be described hereunder. Indoor air sucked through the suction grill 2 by the action of the ventilator 3 passes through the heat exchanger 4, so that cool or hot air is blown indoors from the blowout grill 9. Noise is produced from the ventilator 3 when the ventilator 3 is operated. The noise propagates to the outlet chamber 11 and is absorbed to the porous structure 16 provided in parallel to the partition plate 5, so that noise propagating indoors from the blowout grill 9 is suppressed. The porous structure 16 is formed from a material having continuous pores. The air chamber 21 surrounded by the partition plate 5 and the porous structure 16 is communicated with the outlet chamber 11 through a large number of small pores of the porous structure 16. Except the surface covered with the porous structure 16, the air chamber 21 is surrounded by the partition plate 5, the drain pan 7 and the ceiling panel 1. Accordingly, air blown from the ventilator 3 is not leaked to the outside of the unit through the porous structure 16. On the other hand, noise produced from the ventilator propagates as compressional wave in the air passage in the inside of the unit. When the compressional wave passes through small pores of the porous structure 16, the porous structure serves as resistance to absorb the energy of the compressional wave, that is, acoustic energy. Then, the compressional wave propagates to the air chamber 21 and reflects at the drain pan 7, the partition plate 5 and the decorative panel 6 which serve as an enclosure of the air chamber. As a result, the reflected compressional wave passes through the porous structure 16 again, so that the noise absorbing effect is promoted. That is, the air chamber 21 serves as a back air layer to improve the noise absorbing characteristic of the noise absorbing material formed from a porous structure 16, so that noise produced in the inside of the air conditioner can be reduced greatly. The porous structure 16 is formed by fusion molding of a rigid material such as a bead-shaped plastic material. Accordingly, the porous structure 16 per se can be used as a strength material, so that no member is required for mounting the porous structure 16.

Because the porous structure 16 is shaped like a plate, it can be produced easily.

The present invention has the following effects.

The ventilation system has a fist casing portion disposed in a panel incorporating a ventilator and formed from an airtight structure to form a part of the ventilator, a second casing portion united with the first casing portion into one body and formed from an air-permeable porous structure to form a casing of the ventilator, and an air chamber formed by a partition plate for partitioning the second casing portion and the inlet chamber in the panel. Accordingly, not only noise from the ventilator can be absorbed efficiently but deterioration of the aerodynamic characteristic of the ventilator caused by air leakage can be prevented, so that a low-noise ventilation system can be provided.

The ventilator has a scroll-curve-shaped air-permeable porous structure provided in a casing portion which is arranged opposite to an outlet port of a ventilator casing and deformed so as to be outward different from a scroll curve, and an air chamber formed between the porous structure and the casing portion. Or the ventilator has an air-permeable porous structure which is fixed to a main plate for supporting an impeller of the ventilator and is shaped like a cone in which the inside projecting to the inlet port side is hollow, and an air chamber formed by the porous structure and the main plate. Accordingly, not only noise from the ventilator can be absorbed efficiently but deterioration of the aerodynamic characteristic of the ventilator caused by air leakage can be prevented, so that a low-noise ventilator can be provided.

The air conditioner indoor unit has a concave portion formed by a combination of a drain pan incorporated in a panel, a partition plate and the panel, and a porous structure disposed on the opening side of the concave portion to form an air chamber between the porous structure and the concave portion. Or the air conditioner indoor unit has a porous structure which is disposed in the outer circumference of the end surface of an outlet port of the ventilator so that the outlet port of the ventilator projects out with respect to the partition plate, and an air chamber formed by the partition plate and the panel. Accordingly, not only noise from the ventilator can be absorbed efficiently but deterioration of the aerodynamic characteristic of the ventilator caused by air leakage can be prevented, so that a low-noise air conditioner indoor unit can be provided.

What is claimed is:

1. A ventilation system comprising:

a ventilator positioned in a housing which defines an air inlet chamber, said housing including an air suction port, said ventilator comprising a first casing portion formed from a closed structure, and a second casing portion attached to said first casing portion, said second casing portion being formed from an air permeable porous structure; and a partition plate position ed between said first and second casing portions so as to divide said air inlet chamber into a first chamber in which said first casing portion is positioned, and a second chamber in which said second casing portion is positioned;

wherein the air permeable porous structure of the second casing permits a passage of air from said ventilator to said second chamber, and permits said air, reflected by a portion of said housing which defines said second chamber, to pass back through said permeable porous structure of said second casing.

* * * * *

UNITED STATES PATENT AND TRADEMARK OFFICE

CERTIFICATE OF CORRECTION

PATENT NO. : 5,299,634

DATED : April 5, 1994

INVENTOR(S) : Akinori TOYODA, et al.

It is certified that error appears in the above-indentified patent and that said Letters Patent is hereby corrected as shown below:

On the title page, Item [54] and Column 1, Lines 2-3, the title should read as follows:

--INDOOR UNIT OF A VENTILATION SYSTEM, VENTILATOR AND AIR CONDITIONER--

Signed and Sealed this

Ninth Day of August, 1994

*Attest:*

*Attesting Officer*

Bruce Lehman

BRUCE LEHMAN

*Commissioner of Patents and Trademarks*